US007515146B2

(12) United States Patent
Hayafuji

(10) Patent No.: US 7,515,146 B2
(45) Date of Patent: Apr. 7, 2009

(54) DRIVE DEVICE AND DRIVE METHOD OF LIGHT EMITTING DISPLAY PANEL

(75) Inventor: Akinori Hayafuji, Yonezawa (JP)

(73) Assignee: Tohoku Pioneer Corporation, Tendo-shi (JP)

( * ) Notice: Subject to any disclaimer, the term of this patent is extended or adjusted under 35 U.S.C. 154(b) by 775 days.

(21) Appl. No.: 11/048,731

(22) Filed: Feb. 3, 2005

(65) Prior Publication Data

US 2005/0190128 A1 Sep. 1, 2005

(30) Foreign Application Priority Data

Feb. 5, 2004 (JP) ..... 2004-028855

(51) Int. Cl.
*G09G 5/00* (2006.01)

(52) U.S. Cl. ..... 345/204; 345/76; 345/55; 345/211

(58) Field of Classification Search ..... 345/204, 345/76, 55, 211
See application file for complete search history.

(56) References Cited

U.S. PATENT DOCUMENTS 6,791,306 B2 * 9/2004 Walters et al. ..... 323/288

FOREIGN PATENT DOCUMENTS

JP 2002-366101 12/2002

JP 2003-316315 11/2003

* cited by examiner

*Primary Examiner*—Richard Hjerpe
*Assistant Examiner*—Leonid Shapiro
(74) *Attorney, Agent, or Firm*—Westerman, Hattori, Daniels & Adrian, LLP.

(57) ABSTRACT

The ripple component superimposed on the drive power source Va applied to the source electrode of a light emission drive transistor Tr2 is extracted by a ripple component extraction circuit 14, and the ripple component is supplied to one input terminal of a voltage addition circuit 15. A data voltage Vdata transmitted via a data line is input to the other input terminal of the voltage addition circuit 15. Accordingly, in the voltage addition circuit 15, the ripple component extracted by the ripple component extraction circuit 14 is added to the data voltage Vdata treating the data voltage Vdata as the base. Its output is supplied to a scan selection transistor designated by reference character SW1 as Vgate, and the transistor Tr1 is turned on at an addressing time so that the Vgate is supplied to the gate of the light emission drive transistor Tr2. Thus, the gate-to-source voltage Vgs of the light emission drive transistor Tr2 represents an approximately constant value all the time regardless of timing of addressing. Therefore, a problem that intensity change occurs for each scan line so that the display quality of an image is considerably deteriorated can be avoided.

10 Claims, 9 Drawing Sheets

DRIVE DEVICE AND DRIVE METHOD OF LIGHT EMITTING DISPLAY PANEL

BACKGROUND OF THE INVENTION

1. Field of the Invention

The present invention relates to a drive device of a display panel in which light emitting elements constituting pixels are actively driven for example by TFTs (thin film transistors), and more particularly to a drive device and a drive method of a display panel in which display quality of an image which is caused by a ripple component superimposed onto the drive power source of the light emitting elements can be prevented from deteriorating.

2. Description of the Related Art

A display employing a display panel constructed by arranging light emitting elements in a matrix pattern has been developed widely, and as the light emitting element employed in such a display panel, for example, an organic EL (electroluminescent) element in which an organic material is employed in a light emitting layer has attracted attention. This is because of backgrounds one of which is that by employing, in the light emitting layer of the EL element, an organic compound which enables an excellent light emission characteristic to be expected, a high efficiency and a long life which can be equal to practical use have been advanced.

As the display panel employing such organic EL elements, a simple matrix type display panel in which EL elements are arranged simply in a matrix pattern and an active matrix type display panel in which active elements constituted by the above-mentioned TFTs are added to respective EL elements which are arranged in a matrix pattern have been proposed. The latter active matrix type display panel can realize a low power consumption, compared to the former simple matrix type display panel, and has characteristics such as less cross talk among pixels or the like, thereby being suitable for a high definition display specifically constituting a large screen.

FIG. 1 shows one example of a basic circuit structure corresponding to one pixel and its circuit in a conventional active matrix type display panel and a power supply circuit supplying a drive power source to the display panel in which a large number of the pixels are provided. In the display panel 1 the circuit structure of one pixel 2 is shown for convenience of illustration, and this circuit structure of the pixel 2 shows a most basic pixel structure of a case of a so-called conductance controlled method where the organic EL elements are employed as light emitting elements.

That is, gate electrode (hereinafter simply referred to as gate) of an N-channel type scan selection transistor Tr1 constituted by a TFT is connected to a scan selection line (scan line A1), and source electrode (hereinafter simply referred to as source) is connected to a data line (data line B1). Drain electrode (hereinafter simply referred to as drain) of this scan selection transistor Tr1 is connected to the gate of a P-channel type light emission drive transistor Tr2 and to one terminal of a charge-holding capacitor Cs.

The source of the light emission drive transistor Tr2 is connected to the other terminal of the capacitor Cs and receives supply of a drive power source Va (hereinafter referred to also as drive voltage Va) from a later-described DC-DC converter via a power supply line P1 arranged in the display panel 1. The drain of the light emission drive transistor Tr2 is connected to the anode terminal of an organic EL element E1, and the cathode terminal of this organic EL element E1 is connected to a reference potential point (ground) in the example shown in FIG. 1.

In the circuit structure of the pixel 2, when a select voltage Select is supplied to the gate of the scan selection transistor Tr1 via the scan line A1 during an address period (data writing period), the scan selection transistor Tr1 becomes in an ON state. Upon receiving a data voltage Vdata which corresponds to a write data from the data line B1 supplied to the source of the scan selection transistor Tr1, the scan selection transistor Tr1 allows current corresponding to the data voltage Vdata to flow from the source to the drain. Accordingly, during the period in which the selection voltage Select is applied to the gate of the transistor Tr1, the capacitor Cs is charged, and the charge voltage thereof corresponds to the data voltage Vdata.

Meanwhile, the charge voltage created by charging in the capacitor Cs is supplied to the light emission drive transistor Tr2 as the gate voltage, current based on that gate voltage and the drive voltage Va supplied to the light emission drive transistor Tr2 via the power supply line P1 that is the source voltage flows from the drain to the EL element E1, and the EL element E1 is driven to emit light by the drain current of the light emission drive transistor Tr2.

Here, an addressing operation corresponding to one scan line is completed, and when the gate voltage of the scan selection transistor Tr1 becomes an OFF voltage, this transistor Tr1 becomes so-called cutoff, whereby the drain side of the transistor Tr1 becomes in an open state. However, in the light emission drive transistor Tr2 the gate voltage is maintained by electrical charge accumulated in the capacitor Cs, and the same drive current is maintained until the data voltage Vdata is rewritten during a next address period, whereby the light emission state of the EL element E1 based on this drive current is also maintained.

A large number of the constructions of the pixels 2 described above are arranged in a matrix pattern in the display panel 1 shown in FIG. 1 to construct a dot matrix type display panel, and the respective pixels 2 are respectively formed at crossing positions between respective scan lines A1, . . . and respective data lines B1 . . .

A video signal displayed in the light emitting display panel 2 is supplied to a light emission control circuit 4 shown in FIG. 1. This light emission control circuit 4 converts an input video signal to corresponding pixel data for each one pixel by performing a sampling process or the like based on horizontal and vertical synchronization signals in the video signal and implements a writing operation in which the data is written in an illustrated frame memory sequentially. During the address period after the writing operation for one frame pixel data written in the frame memory is completed, the serial pixel data read out of the frame memory for each one scan line and shift lock signal are sequentially supplied to a shift register and data latch circuit 5*a* in a data driver 5.

This shift register and data latch circuit 5*a* operate to incorporate and latch pixel data corresponding to one horizontal scan, utilizing the above-mentioned shift lock signal, and to supply latch output corresponding to one horizontal scan to a level shifter 5*b* as parallel data. By this operation, the data voltage Vdata corresponding to the pixel data is respectively supplied to the source of the scan selection transistor Tr1 constituting each pixel 2. Such an operation is repeated for each one scan during the address period.

A scan clock signal corresponding to the horizontal synchronization signal is supplied from the light emission control circuit 4 to a scan driver 6 during the address period. This scan clock signal is supplied to a shift register 6*a* so as to operate to generate a register output sequentially. The register output is converted into a predetermined operation level by a level shifter 6*b* and is output to the respective scan lines A1, . . . By this operation, the selection voltage Select is sequentially supplied to the gate of the scan selection transistor Tr1 constituting each pixel 2 for each scan line.

Accordingly, the respective pixels 2 on the display panel 1 arranged on the scan line receive supply of the selection voltage Select from the scan driver 6 for each one scan of the address period. In synchronization with this, the data voltage Vdata is supplied form the level shifter 5*b* in the data driver 5 to the respective pixels 2 arranged for each scan line, and the gate voltage corresponding to the data voltage Vdata is respectively written in the respective pixels (that is, the capacitors Cs) which correspond to this scan line. This operation is executed for the all scan lines so that an image corresponding to one frame is reproduced on the display panel 1.

Meanwhile, the drive voltage Va by the DC-DC converter designated by reference numeral 8 is supplied to the respective pixels 2 arranged in the display panel 1 via the power lines P1 . . . . In the structure shown in this FIG. 1, the DC-DC converter 8 utilizes PWM (pulse width modulation) control to operate to boost the output voltage of a DC voltage source Ba of the primary side.

This DC-DC converter 8 is constructed such that a PWM wave output from a switching regulator circuit 9 performs ON control for a MOS type power FET Q1 provided as a switching element at a predetermined duty cycle. That is, by the ON operation of the power FET Q1, electrical energy from the DC voltage source Ba of the primary side is accumulated in an inductor L1, and the electrical energy accumulated in the inductor L1 is accumulated in a smoothing capacitor C1 via a diode D1, accompanied by an OFF operation of the power FET Q1. By repeats of the ON and OFF operations of the power FET Q1, a boosted DC output can be obtained as a terminal voltage of the capacitor C1.

The DC output voltage is divided by a thermistor TH1 performing temperature compensation and resistances R11 and R12, is supplied to an error amplifier 10 in the switching regulator circuit 9, and is compared to a reference voltage Vref in this error amplifier 10. This comparison output (error output) is supplied to a PWM circuit 11, and by controlling the duty of a signal wave provided from an oscillator 12, the output voltage is feedback controlled so as to be maintained at a predetermined drive voltage Va. Therefore, the output voltage by the DC-DC converter, that is, the drive voltage Va, can be shown as the following Equation 1:

$$Va = Vref \times [(TH1 + R11 + R12)/R12] \quad \text{(Equation 1)}$$

The construction of the pixel structure and the drive circuit therefore as shown in FIG. 1 is disclosed in Japanese Patent Application Laid-Open No. 2003-316315 that the present applicant has already filed, and the DC-DC converter as shown in FIG. 1 is disclosed in Japanese Patent Application Laid-Open No. 2002-366101 that the present applicant has already filed.

Meanwhile, in the structure of the pixel 2 shown in FIG. 1, a drain current Id which drives and allows the organic EL element E1 to emit light is determined by the error (gate-to-source voltage=Vgs of the transistor Tr2) between the drive voltage Va supplied via the power line P1 and the gate voltage of the drive transistor Tr2 which is determined by electrical charge accumulated in the capacitor Cs. FIG. 2 shows an equivalent circuit of the pixel structure, wherein the already explained scan selection transistor Tr1 is replaced and shown by a switch SW1. In FIG. 2, the data voltage Vdata transmitted via the data line B1 is equivalently shown by a gate voltage Vgate by means of a variable voltage source.

Here, for the drive voltage Va supplied to the source of the transistor Tr2, the boosted voltage by the DC-DC converter is employed as already described, and in this type of DC-DC converter, it is unavoidable that ripple noise (ripple component) is superimposed on the voltage Va to some degree since switching operation is accompanied as a matter of its operating principle. In the DC-DC converter, although the level of the ripple component can be decreased more when a large capacitance capacitor is used for the smoothing capacitor C1, decrease effect for the ripple component cannot be expected so much compared to the ratio at which the capacitance thereof is increased.

Particularly, although the demand for the display panel and the DC-DC converter driving this display panel which are shown in FIG. 1 is increasing due to the spread of cellular phones, personal digital assistants (PDAs), and the like, employing a large capacitance smoothing capacitor for this type of equipment not only increases the cost but also increases the occupying volume of the capacitor. Thus, restriction on design that the capacitance of the smoothing capacitor has to be restrained to some degree exists in an actual condition.

Therefore, in the equivalent circuit shown in FIG. 2, the drive voltage Va on which the ripple component shown in FIG. 3 is superimposed is supplied to the source of the light emission drive transistor Tr2. Meanwhile, the switch SW1 is turned on at the addressing time (data write time), and the gate voltage Vgate based on the video signal is supplied to the gate of the drive transistor Tr2. Therefore, a gate-to-source voltage which changes corresponding to the ripple component is supplied between the source and the gate of the transistor Tr2 shown in FIG. 2, in response to respective timings of addressing, as shown as Vgs1, Vgs2, Vgs3 in FIG. 3.

FIG. 4 shows a Vgs/Id characteristic (a gate-to-source voltage versus drain current characteristic) of a TFT, represented by the transistor Tr2, and when the gate-to-source voltage changes within a range of Δvgs, accompanied by this, the drain current also changes within a range of ΔId. Here, it has been known that the organic EL element exhibits a light emission intensity characteristic approximately proportional to the value of the current flowing in this element. Accordingly, as a result of the state in which Vgs changes influenced by the ripple component corresponding to timings of addressing as described above, a result in which the light emission intensity of each EL element in the light emitting display panel 1 differs for each scan line occurs. Thus, in the display panel, a problem that the display quality of an image is considerably deteriorated, that is, for example, a fine striped pattern or phenomenon of flicker occurs and the like, can occur.

In order to avoid such a problem, it can be considered that a regulator circuit for example as shown in FIG. 5 is adopted. That is, the regulator circuit shown in FIG. 5 is interposed between the output terminal of the DC-DC converter and the power supply lines P1, . . . in the display panel 1. The regulator circuit shown in this FIG. 5 is composed of an NPN transistor Q2, an error amplifier constituted by an operational amplifier OP1, and a reference voltage source Vref1. The emitter potential of the NPN transistor Q2 is supplied to the noninverting input terminal of the operational amplifier OP1, and the electrical potential of the reference voltage source Vref1 is supplied to the inverting input terminal of the operational amplifier OP1.

With this structure, the ripple component generated in the emitter side of the transistor Q2 is output to the error amplifier constituted by the operational amplifier OP1. Since the base potential of the transistor Q2 is changed by the output of the error amplifier, as a result, at the emitter side of the transistor Q2, that is, at Vout side, an output voltage in which the ripple component is almost removed can be obtained. However, in the regulator circuit, a power loss of (Vin−Vout)×Iout=P[W] always occurs. Accordingly, due to a problem that the continuous utilization time of a battery is drastically shortened, it is difficult to adopt such a device in the above-mentioned portable equipment under actual conditions.

SUMMARY OF THE INVENTION

The present invention has been developed as attention to the above-described problems has been paid, and it is an object of the present invention to provide a drive device and a drive method of a light emitting display panel in which deterioration of the display quality of an image caused by a ripple component generated in a power supply circuit represented by a DC-DC converter can be effectively reduced without increasing the circuit scale so much.

A drive device of a light emitting display panel according to the present invention which has been developed to solve the problems is a drive device of an active matrix type light emitting display panel in which a large number of light emitting display pixels at least provided with a light emitting element and a light emission drive transistor which is connected in series to the light emitting element in order to drive and allow the light emitting element to emit light are arranged, characterized by comprising ripple component supply means for supplying a ripple component having approximately the same phase and amplitude as those of a ripple component which is supplied to the source electrode of the light emission drive transistor to the gate electrode of the light emission drive transistor.

A drive method of a light emitting display panel according to the present invention which has been developed to solve the problems is a drive method of an active matrix type light emitting display panel in which a large number of light emitting display pixels at least provided with a light emitting element and a light emission drive transistor which is connected in series to the light emitting element in order to drive and allow the light emitting element to emit light are arranged, characterized by supplying a ripple component having approximately the same phase and amplitude as those of a ripple component superimposed on a drive power source which is supplied to the source electrode of the light emission drive transistor to the gate electrode of the light emission drive transistor at an addressing time.

BRIEF DESCRIPTION OF THE DRAWINGS

FIG. 1 is a connection diagram showing one example of a circuit structure corresponding to one pixel in a conventional active matrix type display panel, a power supply circuit which drives and allows this panel to emit light, and-the like.

DESCRIPTION OF THE PREFERRED EMBODIMENTS

Figure 2:
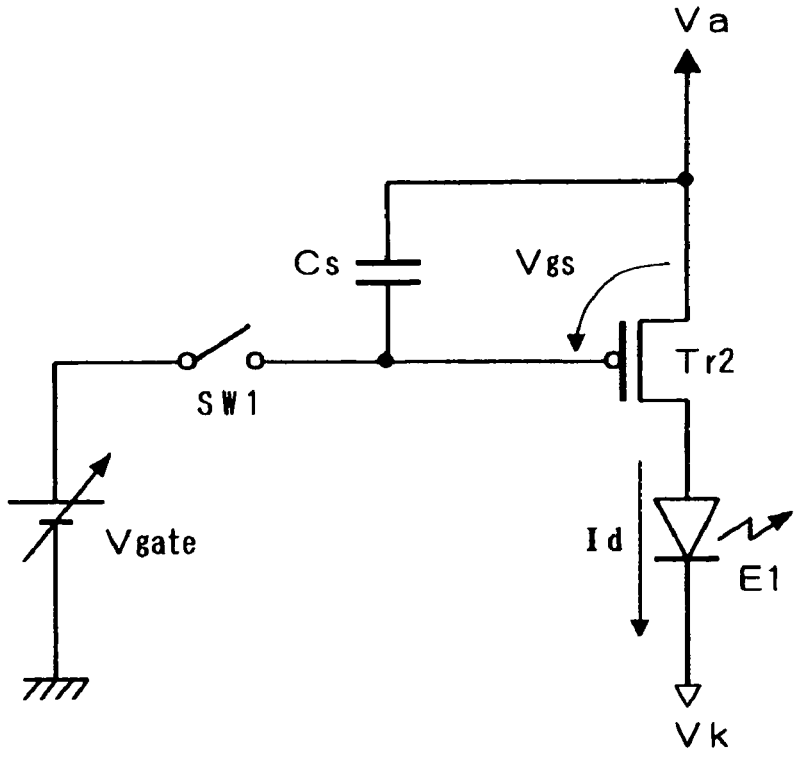
FIG.2 (Prior Art)
FIG. 2 is an equivalent circuit diagram of a pixel structure in a display panel shown in FIG. 1.
Figure 3:
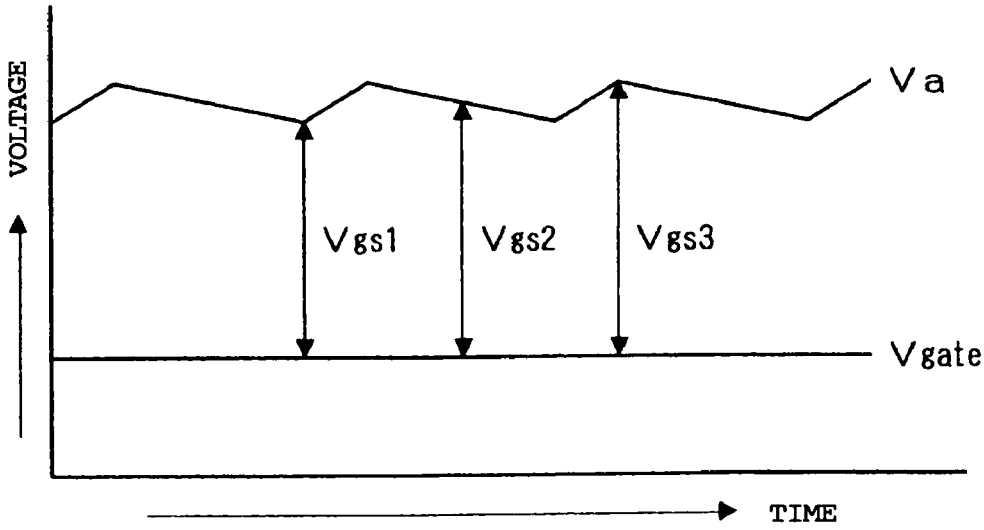
FIG. 3 is a signal waveform explaining a drive voltage which is added to the source electrode of a light emission drive transistor in an equivalent circuit diagram shown in FIG. 2.
Figure 4:
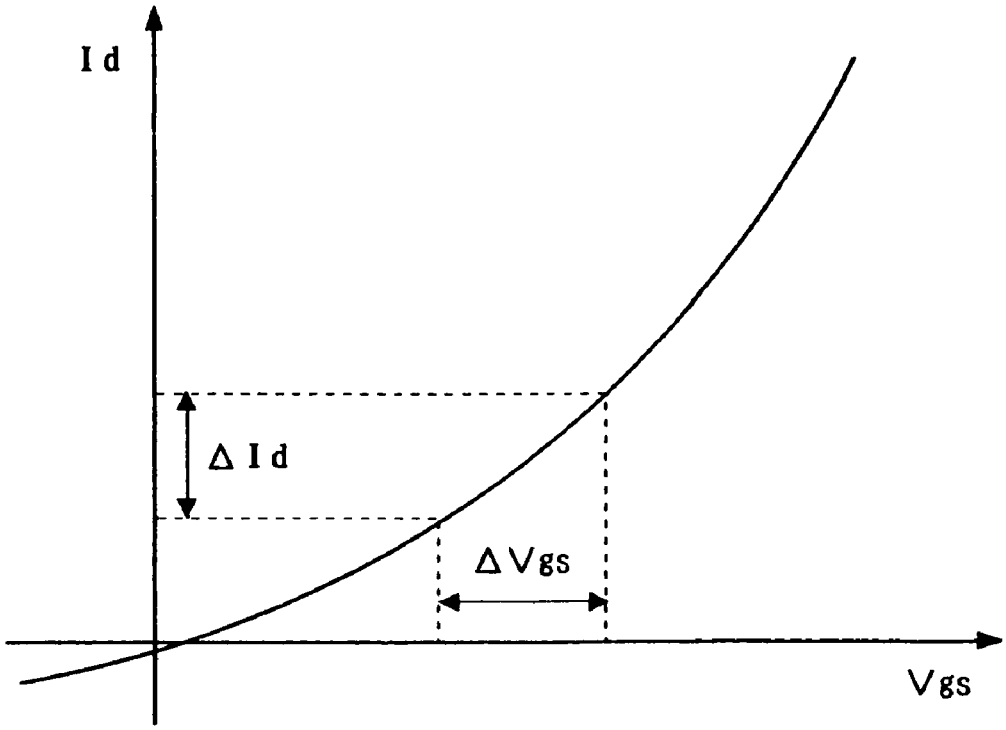
FIG. 4 is a vgs/Id characteristic graph of a TFT represented by the light emission drive transistor shown in FIG. 2.
Figure 5:
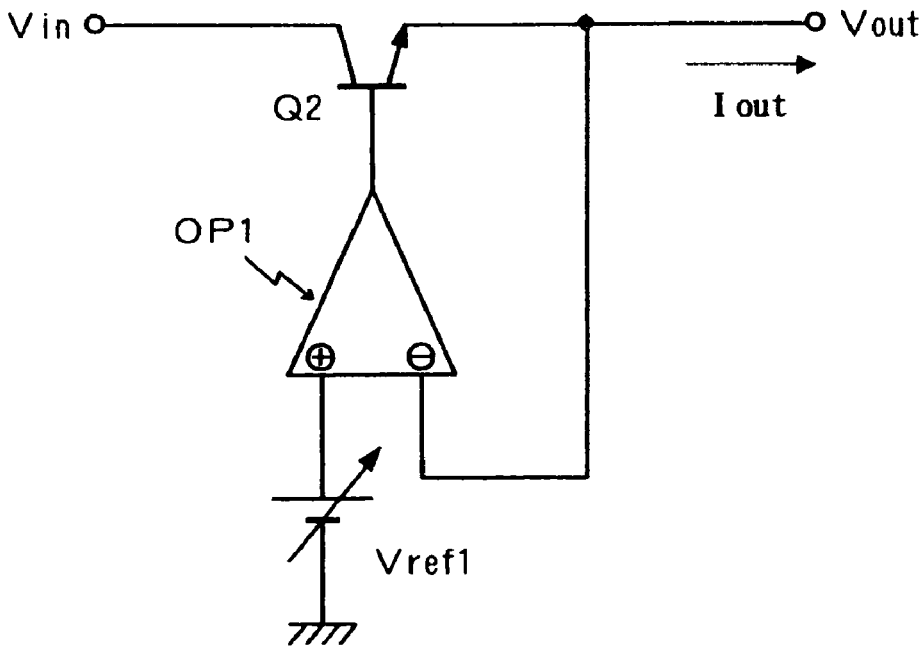
FIG. 5 is a connection diagram showing one example which is to dissolve a problem in a conventional structure shown in FIG. 1.
Figure 6:
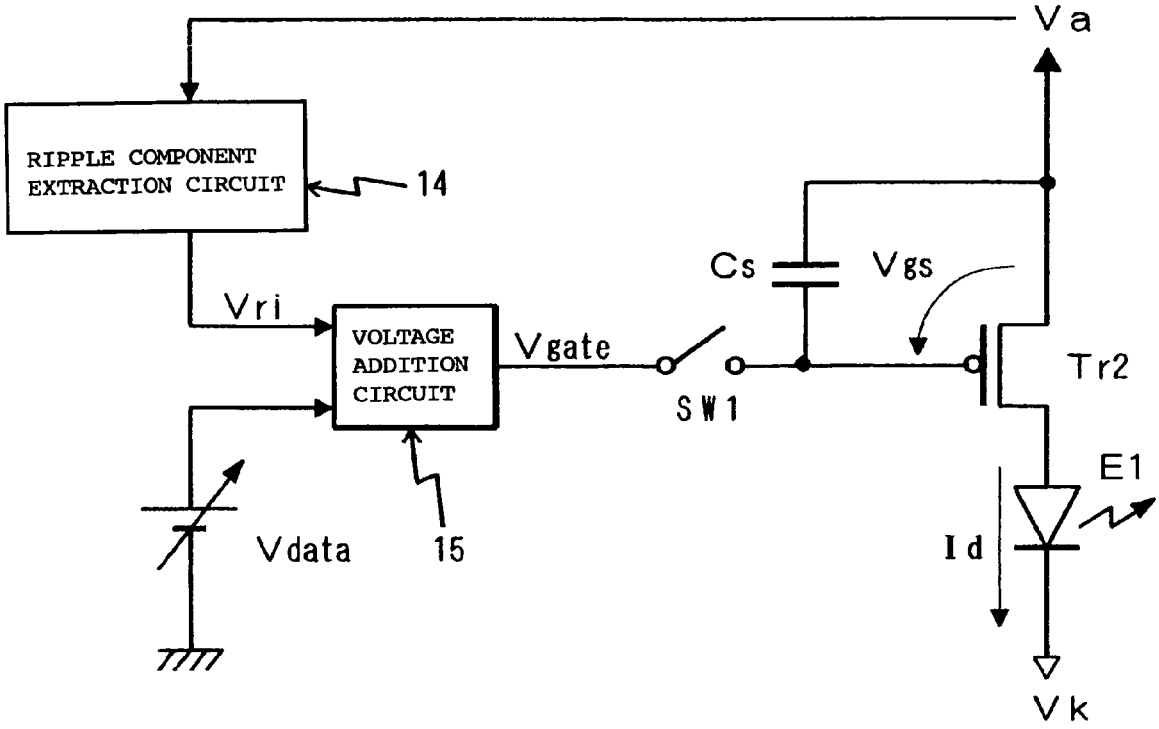
FIG. 6 is an equivalent circuit diagram of a case where a drive device according to the present invention is adopted in a pixel structure of a conductance control drive method.

A drive device of a light emitting display panel according to the present invention will be described below with reference to the embodiments shown in the drawings. FIG. 6 shows a first embodiment of a drive device according to the present invention and shows a structure which is allowed to have ripple component supply means that the present invention is characterized, in a pixel structure of a conductance control method, similarly to the equivalent circuit shown in FIG. 2 already described. In the equivalent circuit of a pixel shown in FIG. 6, parts which perform the same functions as those of the respective parts shown in FIG. 2 are designated by the same reference characters, and detailed description thereof will be omitted.

In the embodiment shown in FIG. 6, a ripple component extraction circuit 14 and a voltage addition circuit 15 are provided and are constituting the ripple component supply means. The ripple component extraction circuit 14 extracts a ripple component included in a drive voltage Va generated by the above-described DC-DC converter, and a ripple component Vri extracted by this ripple component extraction circuit 14 is supplied to one input terminal of the voltage addition circuit 15.The data voltage Vdata transmitted via the above-mentioned data line B1 is input to the other input terminal of the voltage addition circuit 15.

Accordingly, in the voltage addition circuit 15, treating the data voltage Vdata as a base, the ripple component Vri extracted by the ripple component extraction circuit 14 is added to the base. The output thereof as Vgate is supplied to a scan selection transistor Tr1 represented by reference character SW1, and the Vgate is supplied to the gate of a light emission drive transistor Tr2 by the turning on of the transistor Tr1 during the addressing time and is written in a capacitor Cs.

Figure 7:
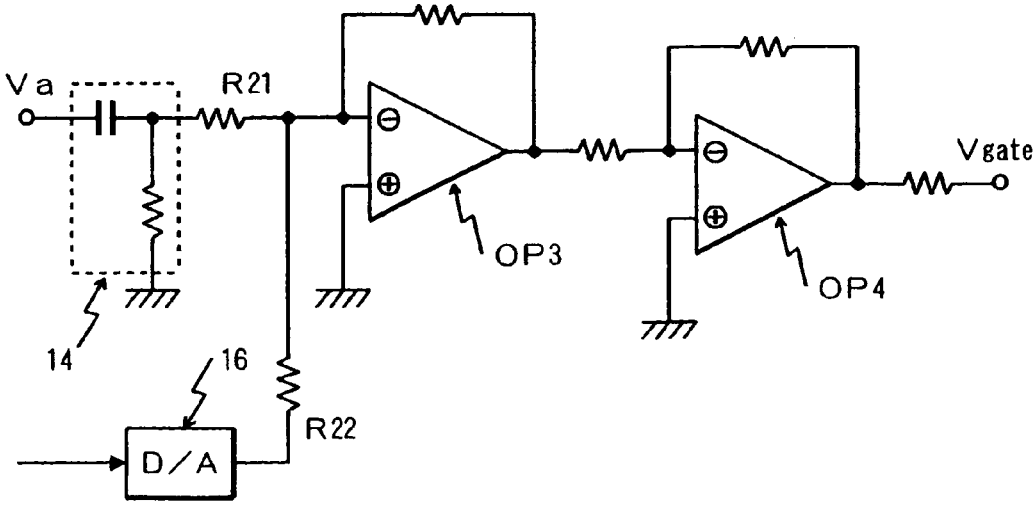
FIG. 7 is a connection diagram showing a specific example of the circuits employed in the structure shown in FIG. 6.

FIG. 7 shows one example of a more specific circuit structure of ripple component supply means composed of the above-mentioned ripple component extraction circuit 14 and voltage addition circuit 15. In FIG. 7, a capacitor and a resistor enclosed by the dashed line constitute a bypass filter, and by this filter, the ripple component extraction circuit 14 extracting the ripple component included in the drive voltage Va is formed. The output thereof is supplied to a negative feedback type voltage buffer circuit constituted by an operational amplifier OP3 via a resistor R21.

The data voltage Vdata transmitted via the above-mentioned data line B1 is equivalently output from a D/A converter designated by reference numeral 16 in the data driver 5 which is already explained. This data voltage Vdata is supplied to a voltage buffer circuit similarly constituted by the operational amplifier OP3 via a resistor R22. The resistors R21, R22 and the operational amplifier OP3 constitute the voltage addition circuit 15 shown in FIG. 6, and the output of the operational amplifier OP3 is further sent via a voltage buffer circuit constituted by an operational amplifier OP4, whereby an output as the above-mentioned Vgate is obtained.

Figure 8:
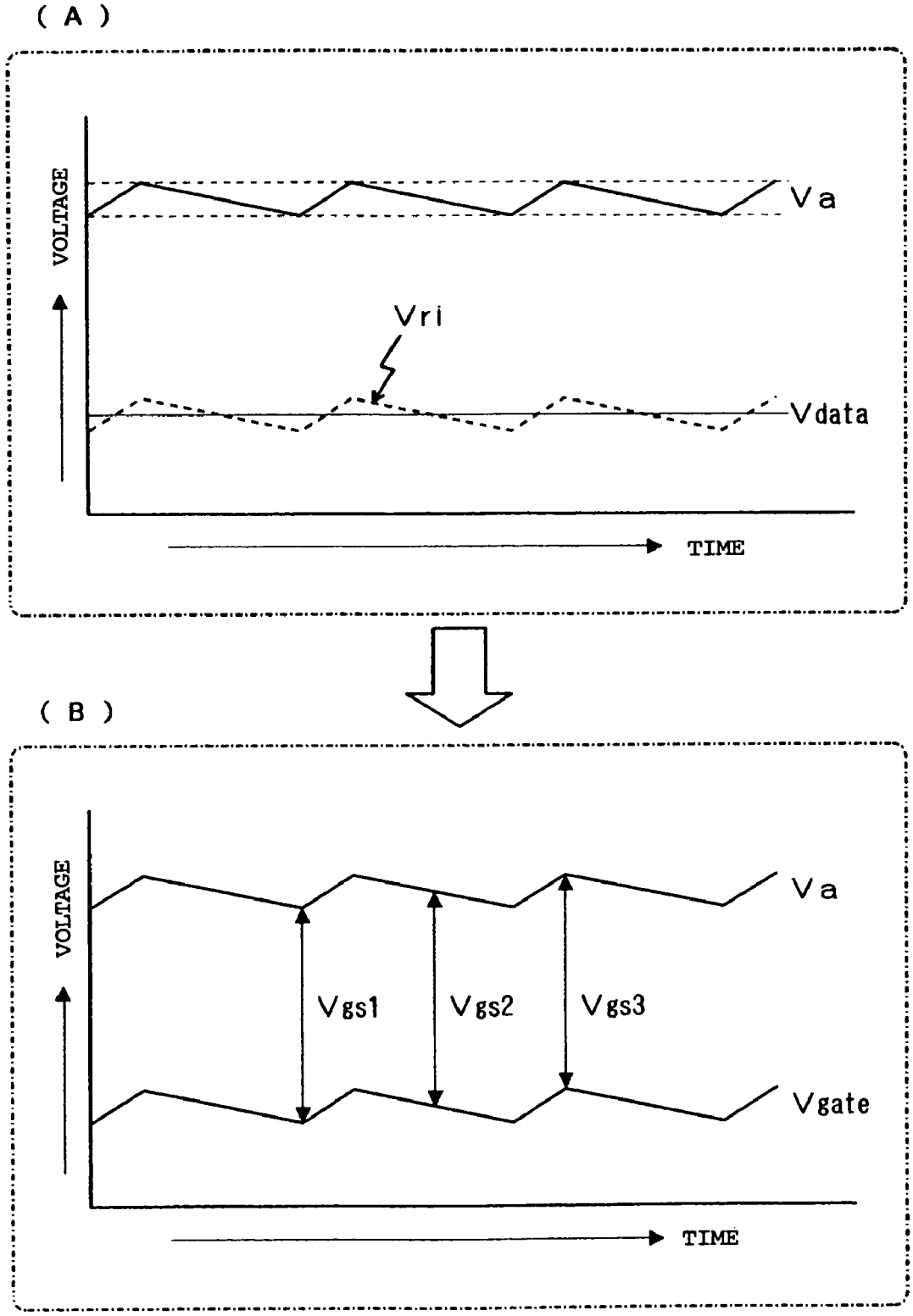
FIG. 8 is signal waveforms explaining an operation performed in the structure shown in FIG. 6.

FIG. 8 explains operations of the ripple component supply means constituted by the ripple component extraction circuit 14 and the voltage addition circuit 15. As shown in FIG. 8A, a ripple component of a level enclosed by upper and lower broken lines is included in the drive voltage Va which is generated by the DC-DC converter. Meanwhile, in the voltage addition circuit 15, as shown in FIG. 8A, a ripple component Vri shown by a broken line obtained-by the ripple component extraction circuit 14 is superimposed on the data voltage Vdata.

Here, it can be said that the ripple component Vri obtained by the ripple component extraction circuit 14 is a ripple component having approximately the same phase and the same amplitude as those of the ripple component supplied to the source of the light emission drive transistor Tr2. Therefore, although a slight delay is produced by the ripple component extraction circuit 14 and the voltage addition circuit 15, the potential difference between the drive voltage Va supplied to the source of the light emission drive transistor Tr2 and the gate voltage Vgate supplied to the gate of the same transistor Tr2, that is, the gate-to-source voltage=Vgs, represents an approximately constant value all the time regardless of timing of addressing as shown in FIG. 8B. That is, as exemplified by Vgs1, Vgs2, Vgs3 in FIG. 8B, the same level of Vgs is applied between the gate and the source at any of addressing timings.

Therefore, a problem that a state is brought in which light emission intensity differs for each scan line in the display panel 1 influenced by a ripple component such that for example a fine striped pattern, phenomenon of flicker, or the like occurs on the display panel can be dissolved. Thus, in the light emission drive operation of the display panel employing as pixels the EL elements having a current-dependent type light emission intensity characteristic, a problem that the display quality of an image is considerably deteriorated can be avoided.

Figure 9:
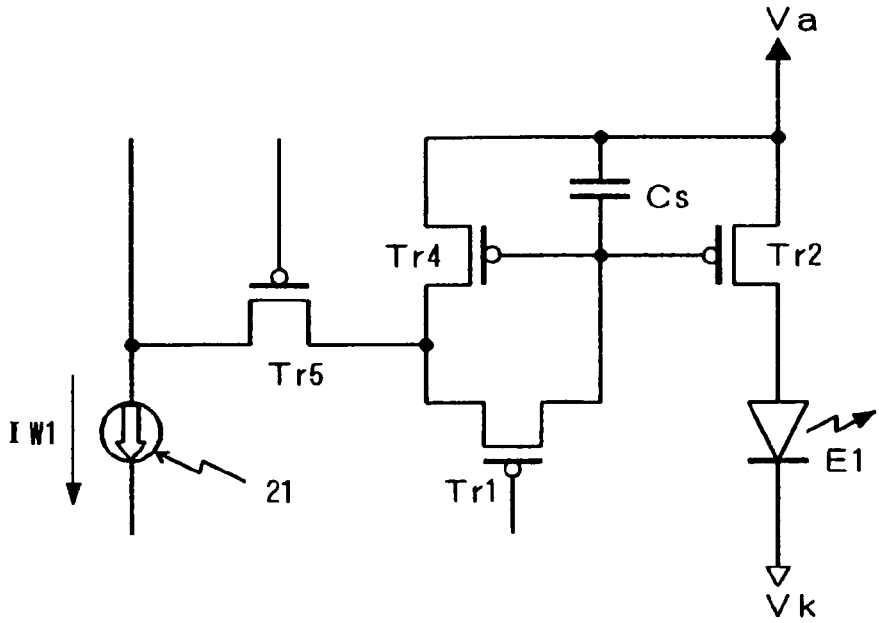
FIG. 9 is a connection diagram of a pixel section of a case where a drive device according to the present invention is adopted in a pixel structure of a current mirror drive method.
Figure 10:
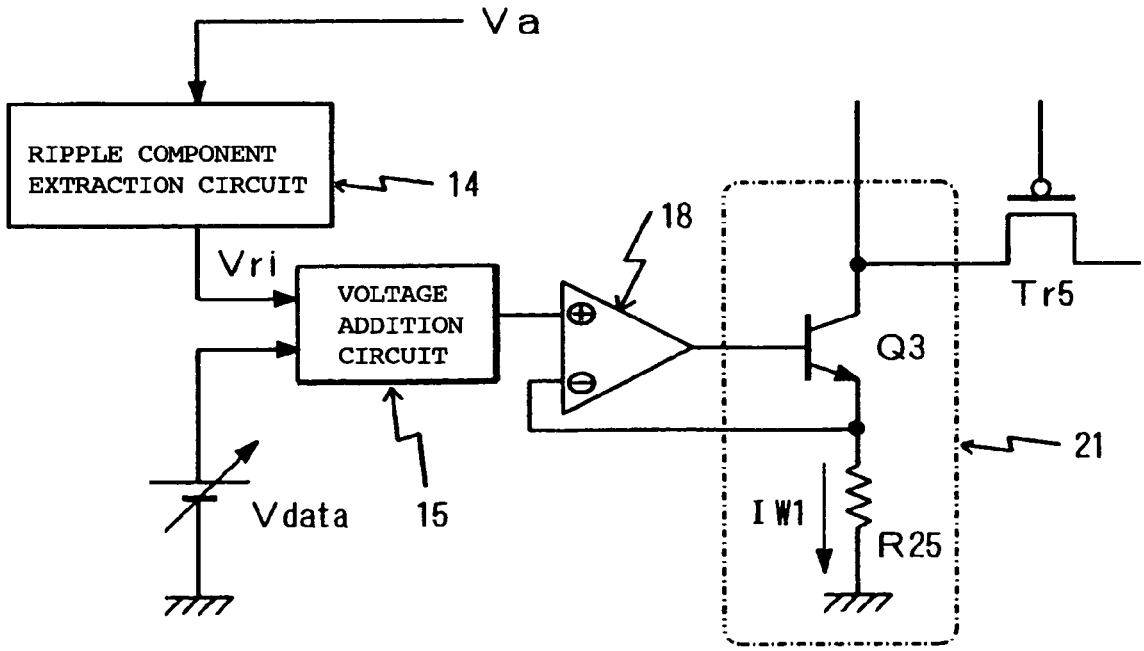
FIG. 10 is a block diagram showing a circuit structure which is appropriately adopted in the pixel structure shown in FIG. 9.

Although the embodiment explained above is aimed at a pixel structure of a conductance control drive method, the form shown in next FIGS. 9 and 10 show an example in which the present invention is adopted in a pixel structure of a current mirror drive method in which a process of writing in a charge-holding capacitor is performed by a current mirror operation.

FIG. 9 shows a pixel structure of a current mirror drive method, and in the example shown in this FIG. 9, a p-channel type light emission drive transistor Tr2 and the same p-channel type mirror operation transistor Tr4 are symmetrically provided wherein the gates thereof are commonly connected, the sources of the both transistors Tr2, Tr4 are commonly connected, and a charge-holding capacitor Cs is connected between the sources and the gates thereof. The drive voltage Va is supplied to the sources of the both transistors Tr2, Tr4.

A scan selection transistor Tr1 constituted by the same p-channel type TFT is connected between the gate and the drain of the mirror operation transistor Tr4, and by an ON operation of this scan selection transistor Tr1, the transistors Tr2, Tr4 function as a current mirror circuit. A write transistor Tr5 constituted by a p-channel TFT is also turned on together with the scan selection transistor Tr1 being turned on, and thus a write current source 21 is connected via the write transistor Tr5.

Accordingly, a current path from the power source Va to the write current source 21 via the transistors Tr4, Tr5 is formed during an address period. By the operation of the current mirror, current corresponding to current IW1 flowing in the power source 21 is supplied to the EL element E1 via the light emission drive transistor Tr2. By this operation, the gate voltage of the transistor Tr4 corresponding to the current IW1 flowing in the write power source 21 is written in the capacitor Cs. After the gate voltage value is written in the capacitor Cs, the scan selection transistor Tr1 is brought to an OFF state, and the light emission drive transistor Tr2 operates to allow a predetermined current (=IW1) to be supplied to the EL element E1 based on electrical charge accumulated in the capacitor Cs, whereby the light emission drive for the EL element E1 is continued.

FIG. 10 shows an example of the structure of the write current source 21 shown in FIG. 9 and a structure controlling the current value of the write current source 21 by the ripple component included in the drive voltage Va. The write current source 21 is constituted by a combination of a PNP type transistor Q3 and a resistor R25 which is connected between the emitter of this transistor Q3 and the ground in the example shown in FIG. 10. The collector of the transistor Q3 is connected to the write transistor Tr5, and the write current source 21 performs a current absorption operation at the ON time of the write transistor Tr5.

The combination shown in FIG. 10 of the ripple component extraction circuit 14, the voltage addition circuit 15, and Vdata represented by the variable voltage source is the same as the structure shown in FIG. 6 already described. The output of the voltage addition circuit 15 is supplied to the base of the transistor Q3 via a voltage amplifier 18 constituted by an operational amplifier. Accordingly, absorption current IW1 by the transistor Q3 constituting the write current source 21 operates such that the current value of the ripple component changes every moment by the ripple component included in the drive voltage Va.

Accordingly, a voltage value corresponding to the data voltage Vdata supplied from the data driver is written in the charge-holding capacitor Cs in the pixel structure of the current mirror drive method shown in FIG. 9 without being influenced by the ripple component included in the drive voltage Va. Therefore, in the pixel structure of the current mirror drive method shown in FIG. 9, by adopting the circuit structure shown in FIG. 10, a problem that a state is brought in which light emission intensity differs for each scan line in the display panel 1 influenced by the ripple component can be avoided.

Figure 11:
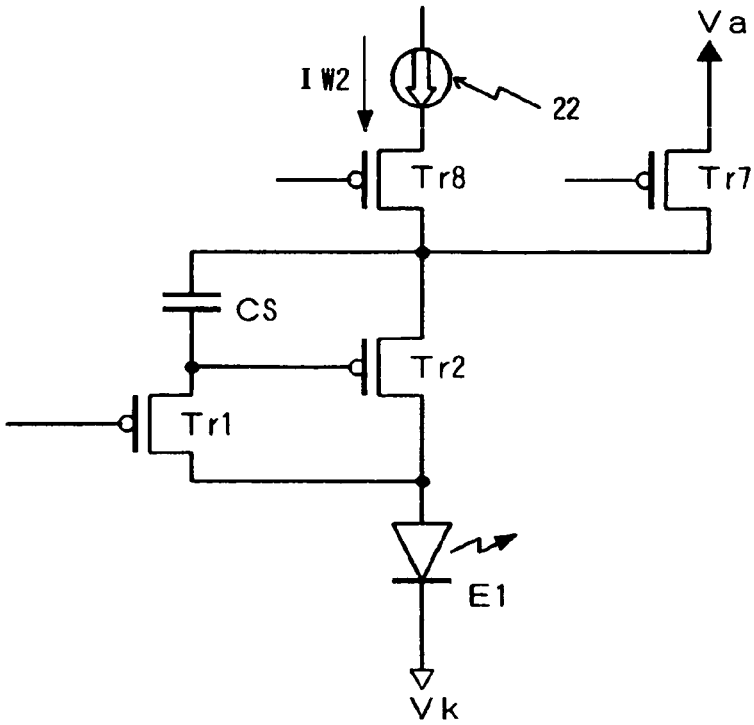
FIG. 11 is a connection diagram of a pixel section of a case where a drive device according to the present invention is adopted in a pixel structure of a current programming drive method.
Figure 12:
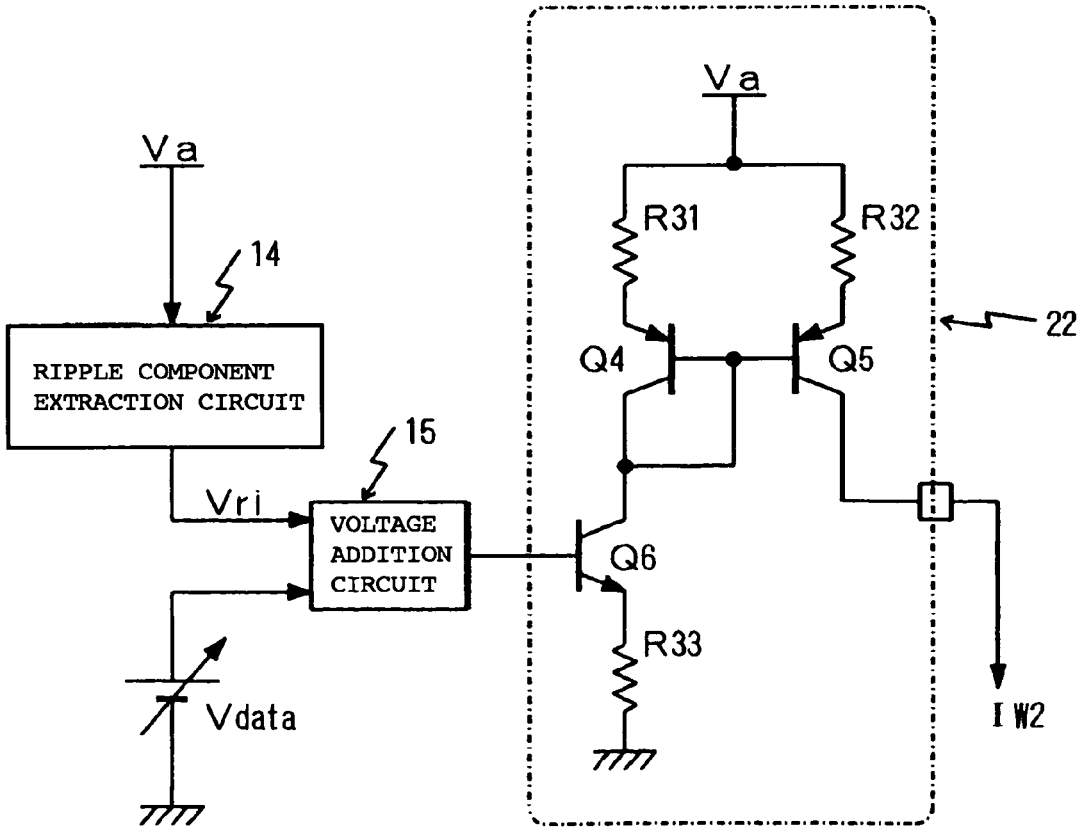
FIG. 12 is a block diagram showing a circuit structure which is appropriately adopted in the pixel structure shown in FIG. 11.

The form shown in next FIGS. 11 and 12 show an example in which the present invention is adopted in a pixel structure of a current programming drive method. FIG. 11 shows a pixel structure of a current programming drive method, and a series circuit of a power supplying transistor Tr7 and a light emission drive transistor Tr2 both constituted by p-channel type TFTs and the EL element E1 is interposed between the power source Va and Vk. The charge-holding capacitor Cs is connected between the source and the gate of the light emission drive transistor Tr2, and a p-channel type scan selection transistor Tr1 is connected between the gate and the drain of the same transistor Tr2. A write current source 22 is connected to the source of the light emission drive transistor Tr2 via a write transistor Tr8 constituted by a p-channel type TFT.

In the structure shown in FIG. 11, a control signal is supplied to respective gates of the scan selection transistor Tr1 and the write transistor Tr8 during the addressing time, and these are brought to an ON state. Accompanied by this, the light emission drive transistor Tr2 is also turned on, current IW2 from the write current source 22 flows via the light emission drive transistor Tr2. At this time, the gate-to-source voltage Vgs of the light emission drive transistor Tr2 corresponding to the current IW2 provided from the write current source 22 is maintained in the capacitor Cs.

Meanwhile, both the scan selection transistor Tr1 and the write transistor Tr8 are brought to an OFF state during the light emission operation of the EL element, and the power supplying transistor Tr7 is turned on. Thus, the drive voltage Va is applied to the source side of the light emission drive transistor Tr2. Therefore, the drain current of the light emission drive transistor Tr2 is determined by the electrical charge maintained by the capacitor Cs, and by this the EL element E1 is driven to emit light.

In the pixel structure shown in FIG. 11, a data voltage is written in the capacitor Cs by the write current IW2 supplied from the write current source 22, during the addressing time. Meanwhile, since the current IW2 brought by the write current source 22 is generated utilizing the drive power source Va by the DC-DC converter, the ripple component is superimposed on the current IW2. Thus, a state in which the light emission intensity differs for each scan line takes place influenced by the ripple component, and a problem that the display quality is deteriorated occurs.

In the pixel structure of the current programming drive method shown in FIG. 11, by adopting the circuit structure shown in FIG. 12, the above-mentioned problem can be avoided. Reference numeral 22 in FIG. 12 designates the write current source shown in FIG. 11, and this write current source 22 constitutes a current mirror circuit. That is, in this current mirror circuit, respective emitters of PNP type transistors Q4, Q5 are connected to the drive power source Va via respective resistors R31, R32 which are connected thereto, and the bases of the respective transistors Q4, Q5 are commonly connected. The base and collector of the transistor Q4 constituting a current control side are directly connected.

The collector of an NPN type transistor Q6 is connected to the collector of the transistor Q4, and the emitter thereof is connected to the ground via a resistor R33. The write current IW2 is output from the collector of the transistor Q5. Here, the combination of the ripple component extraction circuit 14, the voltage addition circuit 15, and Vdata represented by the variable voltage source is the same as the structure shown in FIGS. 6 and 10 already described, and such a structure is constructed such that the output of the voltage addition circuit 15 is supplied to the base of the transistor Q6 constituting the current mirror circuit.

Accordingly, while current flowing in the current mirror circuit is influenced by the ripple component superimposed on the power source Va that drives this current mirror circuit, current control in the current mirror circuit is executed by the ripple component supplied by the voltage addition circuit 15 shown in FIG. 12, and the value of the write current IW2 output as a result is produced as a write current which is hardly influenced by the ripple component superimposed on the power source Va.

Therefore, a voltage value corresponding to the data voltage Vdata supplied from the data driver is written in the charge-holding capacitor Cs in the pixel structure of the current programming drive method shown in FIG. 11, without being influenced by the ripple component included in the drive voltage Va. Accordingly, in the pixel structure of the current programming drive method shown in FIG. 11, by adopting the circuit structure shown in FIG. 12, a problem that a state is brought in which light emission intensity differs for each scan line in the display panel 1 influenced by the ripple component can be avoided.

Figure 13:
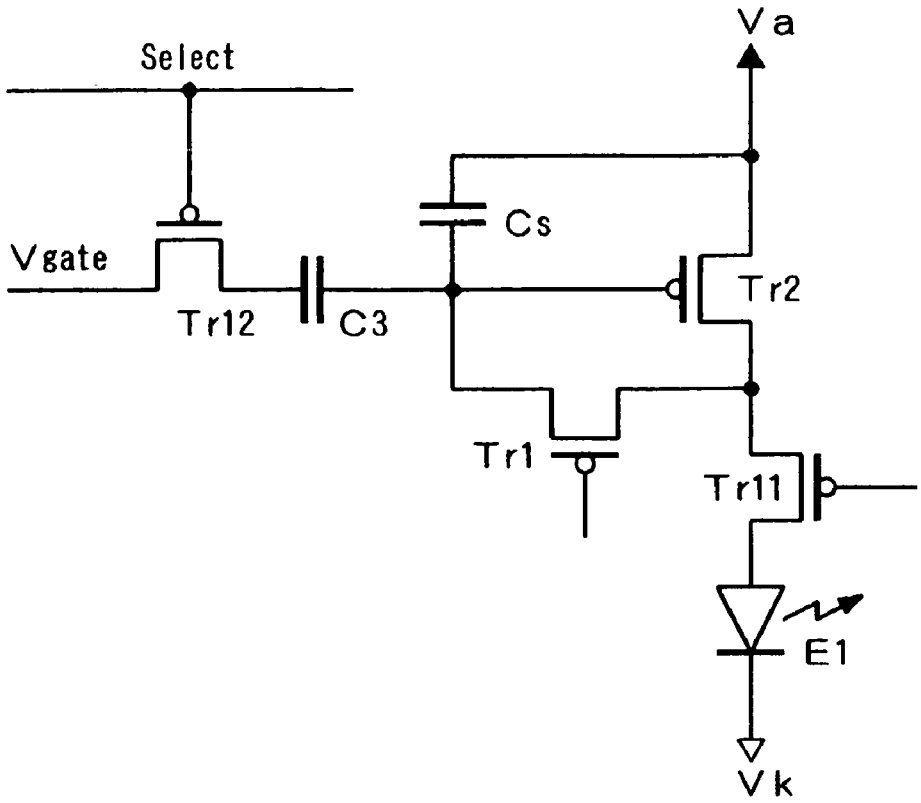
FIG. 13 is a connection diagram of a pixel section of a case where a drive device according to the present invention is adopted in a pixel structure of a voltage programming drive method.

Next, the form shown in FIG. 13 shows a pixel structure of a voltage programming drive method. In the structure shown in this FIG. 13, to the light emission drive transistor Tr2 constituted by a p-channel type TFT, a switching transistor Tr11 constituted by the same p-channel type TFT is connected in series, and further the EL element E1 is connected in series to the transistor Tr11. The power source Va and the power source Vk are supplied to the source of the light emission drive transistor Tr2 and the cathode terminal of the EL element E1, respectively.

The charge-holding capacitor Cs is connected between the gate and the source of the light emission drive transistor Tr2, and a scan selection transistor Tr1 constituted by a p-channel type TFT is connected between the gate and the drain of the light emission drive transistor Tr2. In addition to this, in the pixel structure of this voltage programming drive method, to the gate of the light emission drive transistor Tr2, a write transistor Tr12 constituted by a p-channel type TFT and a capacitor C3 are connected in series.

A selection voltage Select is supplied to the gate of the write transistor Tr12 via the scan line A1, and the voltage Vgate, that is, the output by the voltage addition circuit 15 shown in FIG. 6, is supplied to the source of the transistor Tr12.

In the pixel structure of the voltage programming drive method, the scan selection transistor Tr1 and the switching transistor Tr11 are turned on during the addressing time, and accompanied by this, the ON state of the light emission drive transistor Tr2 is maintained. At a next moment, the transistor Tr11 is turned off, so that the drain current of the light emission drive transistor Tr2 turns to the gate of the light emission drive transistor Tr2 via the scan selection transistor Tr1. Thus, the gate-to-source voltage of the light emission drive transistor Tr2 is boosted until the gate-to-source voltage becomes equal to the threshold voltage of the transistor Tr2, and at this time the light emission drive transistor Tr2 is turned off.

The threshold voltage between the gate and the source of the light emission drive transistor Tr2 of this time is maintained in the capacitor Cs. That is, in this voltage programming drive method, variations in the threshold voltage of the light emission drive transistors Tr2 are compensated. At the addressing time within the time when the selection voltage Select is supplied to the gate of the write transistor Tr12, the electrical charge is written in the capacitor Cs by the output Vgate by the voltage addition circuit 15 shown in FIG. 6, and thus the EL element E1 is driven to emit light.

In the embodiment shown in FIG. 13, the potential difference between the drive voltage Va supplied to the source of the light emission drive transistor Tr2 and the gate voltage Vgate supplied to the gate of the same transistor Tr2, that is, the gate-to-source voltage=Vgs, represents an approximately constant value all the time regardless of timing of addressing. Therefore, in the structure shown in FIG. 13 also, the problem that intensity change occurs for each scan line so that display quality of an image is considerably deteriorated can be avoided.

Figure 14:
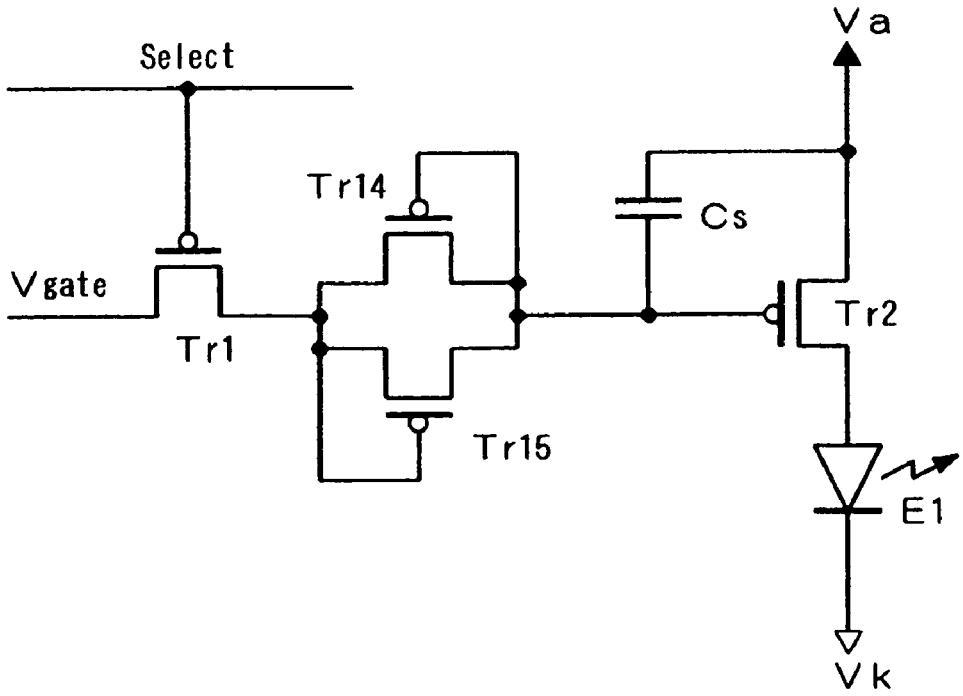
FIG. 14 is a connection diagram of a pixel section of a case where a drive device according to the present invention is adopted in a pixel structure of a threshold voltage compensation drive method.

The form shown in FIG. 14 shows an example in which the present invention is adopted in a pixel structure which is called a threshold voltage compensation drive method. In the structure shown in this FIG. 14, the EL element E1 is connected in series to the light emission drive transistor Tr2 constituted by a p-channel type TFT, and the power source Va and the power source Vk are supplied to the source of the light emission drive transistor Tr2 and the cathode terminal of the EL element E1, respectively.

The charge-holding capacitor Cs is connected between the gate and the source of the light emission drive transistor Tr2, and further a parallel connection body of two transistors Tr14 and Tr15 constituted by p-channel type TFTs is interposed between the drain of the scan selection transistor Tr1 constituted by a p-channel type TFT and the gate of the light emission drive transistor Tr2.

In the parallel connection body of the two transistors Tr14 and Tr15, the respective gates and drains are short circuited, and substantially the sources and the gates of the transistors Tr14 and Tr15 are connected in reverse parallel. Therefore, the transistors Tr14 and Tr15 function as voltage generating elements which give a threshold characteristic from the scan selection transistor Tr1 toward the gate of the light emission drive transistor Tr2. That is, the voltage generation elements composed of the transistors Tr14 and Tr15 level-shift the voltage corresponding to the threshold voltage of the light emission drive transistor Tr2 to supply it to the gate of the light emission drive transistor Tr2.

With this structure, since the threshold characteristics in mutual transistors formed in one pixel are allowed to be extremely approximate characteristics, the threshold characteristic of the light emission drive transistor Tr2 can be effectively cancelled.

In the embodiment shown in this FIG. 14, the selection voltage Select is supplied to the gate of the scan selection transistor Tr1 via the scan line A1, and the voltage Vgate, that is, the output by the voltage addition circuit 15 shown in FIG. 6 is supplied to the source of the transistor Tr1.

In the pixel structure of the threshold voltage compensation drive method shown in this FIG. 14 also, at the addressing time when the selection voltage Select is supplied to the gate of the scan selection transistor Tr1, electrical charge is written in the capacitor Cs by the output Vgate by the voltage addition circuit 15 shown in FIG. 6, and by this, the EL element E1 is driven to emit light.

Accordingly, in the embodiment shown in FIG. 14 also, the potential difference between the drive voltage Va supplied to the source of the light emission drive transistor Tr2 and the gate voltage Vgate supplied to the gate of the same transistor Tr2, that is, the gate-to-source voltage=Vgs, represents an approximately constant value all the time regardless of timing of addressing. Therefore, in the structure shown in FIG. 14 also, the problem that intensity change occurs for each scan line so that display quality of an image is considerably deteriorated can be avoided.

In the embodiments described above, the ripple component included in the drive power source Va generated for example by a DC-DC converter is extracted by the ripple component extraction circuit, and the extracted ripple component is employed such that the effect of the ripple component superimposed on the power source Va is cancelled at the write time of electrical charge in the capacitor Cs. However, in a drive device of a display panel according to the present invention, the effect of the ripple component superimposed on the power source Va can be similarly cancelled utilizing the ripple component generated for example based on a switching signal which is utilized in the DC-DC converter.

Figure 1:
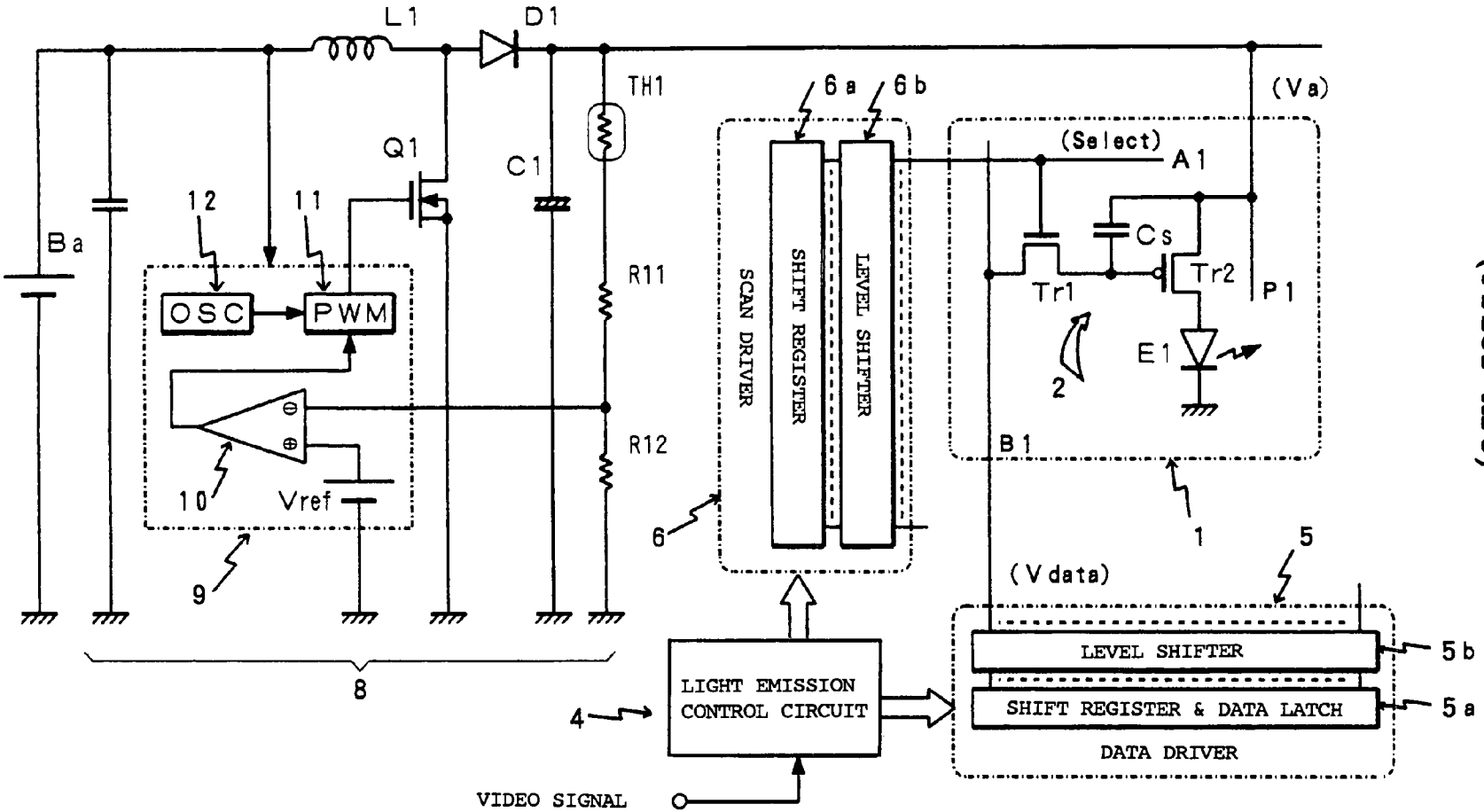
FIG.1 (Prior Art)
Figure 15:
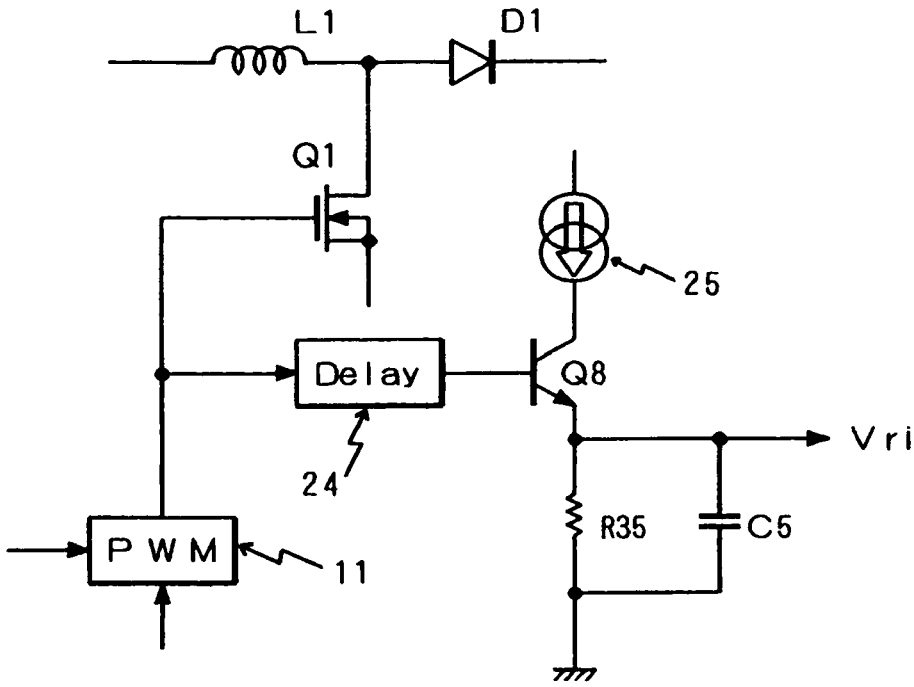
FIG. 15 is a connection diagram showing another example in which a ripple component included in the drive power source is generated.

FIG. 15 shows such an example, and reference characters L1, D1, Q1, and 11 designate switching circuit parts in the DC-DC converter shown in FIG. 1. In the structure shown in FIG. 15, the switching signal which is provided from the PWM circuit 11 and which is added to the gate of the power FET Q1 is utilized to control ON/OFF of an NPN type transistor Q8. A constant current source 25 is connected to the collector of this transistor Q8, and a parallel connection circuit composed of a capacitor C5 and a resistor R35 is interposed between the emitter and the reference potential point (ground). A ripple component Vri is extracted from the emitter of the transistor Q8. In the embodiment shown in FIG. 15, a delay circuit 24 lies between the PWM circuit 11 and the base of the transistor Q8.

Figure 16:
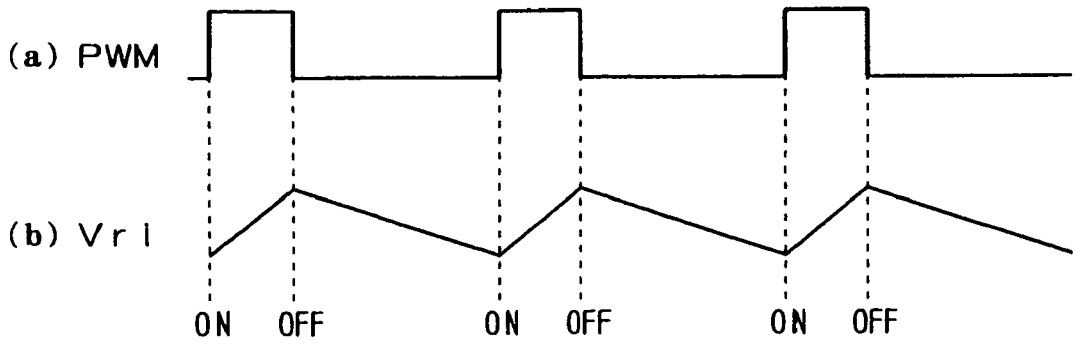
FIG. 16 is a timing diagram explaining operations in the circuit shown in FIG. 15.

With the structure shown in FIG. 15, ON/OFF of the transistor Q8 is controlled by a PWM signal shown in FIG. 16(*a*). Here, when the transistor Q8 is turned on, a charge operation is performed for the capacitor C5 by current from the constant current source 25 via the transistor Q8. Therefore, the output at the emitter of the transistor Q8 increases in response to the value of the charge current from the constant current source 25 as shown in FIG. 16(*b*). When the transistor Q8 is turned off, electrical charge charged in the capacitor C5 is discharged via the resistor R35. Accordingly, the emitter output of the transistor Q8 decreases in response to the time constant of the capacitor C5 and the resistor R35 as shown in FIG. 16(*b*).

Accordingly, the ripple component Vri as shown in FIG. 16(*b*) can be obtained at the emitter of the transistor Q8 shown in FIG. 15 by repeated operations as described above. By performing a process such as a level conversion and the like for the ripple component Vri generated at the emitter of this transistor Q8 as the need arises, the ripple component Vri can be utilized as the ripple component Vri which is input to the voltage addition circuit 15 in FIGS. 6, 10, and 12 already described.

The delay circuit 24 lies between the PWM circuit 11 and the base of the transistor Q8 as described above, so that a delay is imposed on the PWM signal which is from the PWM circuit 11 and which is shown in FIG. 16(*a*). Accordingly, phases of the ripple component superimposed on the power source Va and of the ripple component Vri generated at the emitter of the transistor Q8 can be matched by a delay characteristic by the delay circuit 24.

In the respective embodiments described above, although organic EL elements are employed as light emitting elements, another light emitting element whose light emission intensity depends on a drive current also can be employed. The respective structures of pixels described above exemplify representative structures, and the present invention can be appropriately adopted in a drive device of a light emitting display panel employing a pixel structure other than the above-described pixel structures.

What is claimed is:

1. A drive device of an active matrix type light emitting display panel in which a large number of light emitting display pixels at least provided with a light emitting element and a light emission drive transistor which is connected in series to the light emitting element in order to drive and allow the light emitting element to emit light are arranged, and a drive power source for driving and allowing the light emitting elements to emit light is connected to the source electrode of the light emission drive transistor, characterized by comprising ripple component supply means for supplying a ripple component having approximately the same phase and amplitude as those of a ripple component superimposed on a drive power source to a gate electrode of the light emission drive transistor.

2. The drive device of the light emitting display panel according to claim 1, characterized by being constructed such that the ripple component supply means comprises a ripple component extraction circuit which extracts a ripple component from the drive power source so that the ripple component extracted by the ripple component extraction circuit is supplied to the gate electrode of the light emission drive transistor at an addressing time.

3. The drive device of the light emitting display panel according to claim 1, characterized in that the drive power source which supplies current to the source of the light emission drive transistor is generated by a switching type DC-DC converter.

4. The drive device of the light emitting display panel according to claim 2, characterized in that the drive power source which supplies current to the source of the light emission drive transistor is generated by a switching type DC-DC converter.

5. The drive device of the light emitting display panel according to claim 3, characterized in that the ripple component supply means is constructed so as to supply a ripple component generated based on a switching signal utilized in the DC-DC converter to the gate electrode of the light emission drive transistor at an addressing time.

6. The drive device of the light emitting display panel according to claim 4, characterized in that the ripple component supply means is constructed so as to supply a ripple component generated based on a switching signal utilized in the DC-DC converter to the gate electrode of the light emission drive transistor at an addressing time.

7. The drive device of the light emitting display panel according to any one of claims 1 to 6, characterized by being constructed such that each pixel arranged in the light emitting display panel includes a scan selection transistor which gives an electrical potential to the gate electrode of the light emission drive transistor so that the ripple component is supplied to the gate electrode of the light emission drive transistor via the scan selection transistor.

8. A self light emitting display module according to any one of claims 1 to 6, characterized in that the light emitting element constituting the light emitting display pixel is an organic EL element in which an organic compound is employed in a light emitting layer.

9. A self light emitting display module according to claim 7, characterized in that the light emitting element constituting the light emitting display pixel is an organic EL element in which an organic compound is employed in a light emitting layer.

10. A drive method of an active matrix type light emitting display panel in which a large number of light emitting display pixels at least provided with a light emitting element and a light emission drive transistor which is connected in series to the light emitting element in order to drive and allow the light emitting element to emit light are arranged, characterized by supplying a ripple component extracted by a ripple component extraction circuit to the gate electrode of the light emission drive transistor at an addressing time, said ripple component having approximately the same phase and amplitude as those of a ripple component superimposed on a drive power source voltage which is supplied to the source electrode of the light emission drive transistor.

* * * * *